US006640476B1

(12) United States Patent
Miller

(10) Patent No.: US 6,640,476 B1
(45) Date of Patent: Nov. 4, 2003

(54) ILLUMINATED MOUNTING SUPPORT FOR TRANSPARENT MEDIA WITH IMAGE TO CREATE SHADOW EFFECT

(76) Inventor: Jeffrey A. Miller, 5209 Headgates Rd., Hamilton, OH (US) 45011

( * ) Notice: Subject to any disclaimer, the term of this patent is extended or adjusted under 35 U.S.C. 154(b) by 0 days.

(21) Appl. No.: 10/174,438

(22) Filed: Jun. 19, 2002

(51) Int. Cl.[7] ..... G09F 13/00
(52) U.S. Cl. ..... 40/560; 40/715; 40/743
(58) Field of Search ..... 40/427, 560, 715, 40/743, 559, 777, 778

(56) References Cited

U.S. PATENT DOCUMENTS

| | | | | | |
|---|---|---|---|---|---|
| 1,409,114 | A | * | 3/1922 | Loveberg | 40/715 |
| 1,712,371 | A | * | 5/1929 | Wilkins | 40/560 |
| 6,036,334 | A | * | 3/2000 | Nakano | 40/715 |
| 6,502,339 | B1 | * | 1/2003 | Shapiro | 40/560 |

* cited by examiner

*Primary Examiner*—Gary Hoge
(74) *Attorney, Agent, or Firm*—Jack C. McGowan

(57) ABSTRACT

A support for a glass etching includes a lamp and offset mounts whereby an image is projected onto the support creating a shadow effect.

8 Claims, 2 Drawing Sheets

ILLUMINATED MOUNTING SUPPORT FOR TRANSPARENT MEDIA WITH IMAGE TO CREATE SHADOW EFFECT

BACKGROUND OF INVENTION

1. Field of the Invention

The present invention relates to an illuminated mounting support for glass etchings and the like which projects an image behind the etching.

2. Description of the Related Art

Illuminated signs utilizing transparent sheets are known in which a light source is disposed along one edge of the sheet material (U.S. Pat. No. 5,829,177) or the light source is disposed behind a rearmost face of the sign place (U.S. Pat. No. 5,009,019).

Picture frames in which a strip of light can be positioned into a portion of the frame for illuminating glass etchings are also described in the prior art. (U.S. Pat. No. 5,555,654.) However, such frames are complex in construction, require a strip of light positioned about the edge of the etching and do not produce a ghost-like or shadow effect.

OBJECT OF THE PRESENT INVENTION

The primary objective of the present invention is to provide an illuminated support for a glass etching which produces a ghost-like effect of the image by positioning a lamp and the glass etching such that a projection of the image occurs. The illusion creates a sense of depth and mimics the appearance of an enlarged carbon sketch of the image on a surface of the support.

It is another object of my invention to provide a mounting support for a variety of transparent media such as glass, transparent plastic, plexiglass and acrylic such that an image printed or engraved or embedded on the media can be illuminated thereby creating a ghost-like effect behind the image.

It is a further object of the invention to provide a novel illuminated mounting support for transparent media which will create a shadow effect for an image on or in the transparent media.

It is a further object of the invention to create a form of art that is adaptable to conditions where there is a low level of ambient light.

It is another object of the present invention to create a new and unique display of artwork.

BRIEF DESCRIPTION OF THE DRAWINGS

Refer in particular to the drawings for the purpose of illustration only, there is depicted.

GENERAL DESCRIPTION OF THE PRESENT INVENTION

As used in this specification, the terms "ghost-like effect" and "shadow effect" mean that an image, which can be etched, printed or otherwise embedded, as examples, in a transparent media, is projected and enlarged on an offset reflective surface therebehind so that the image in combination with the projected image gives the appearance of depth and mimics the appearance of an enlarged carbon sketch of the image.

Figure 1:
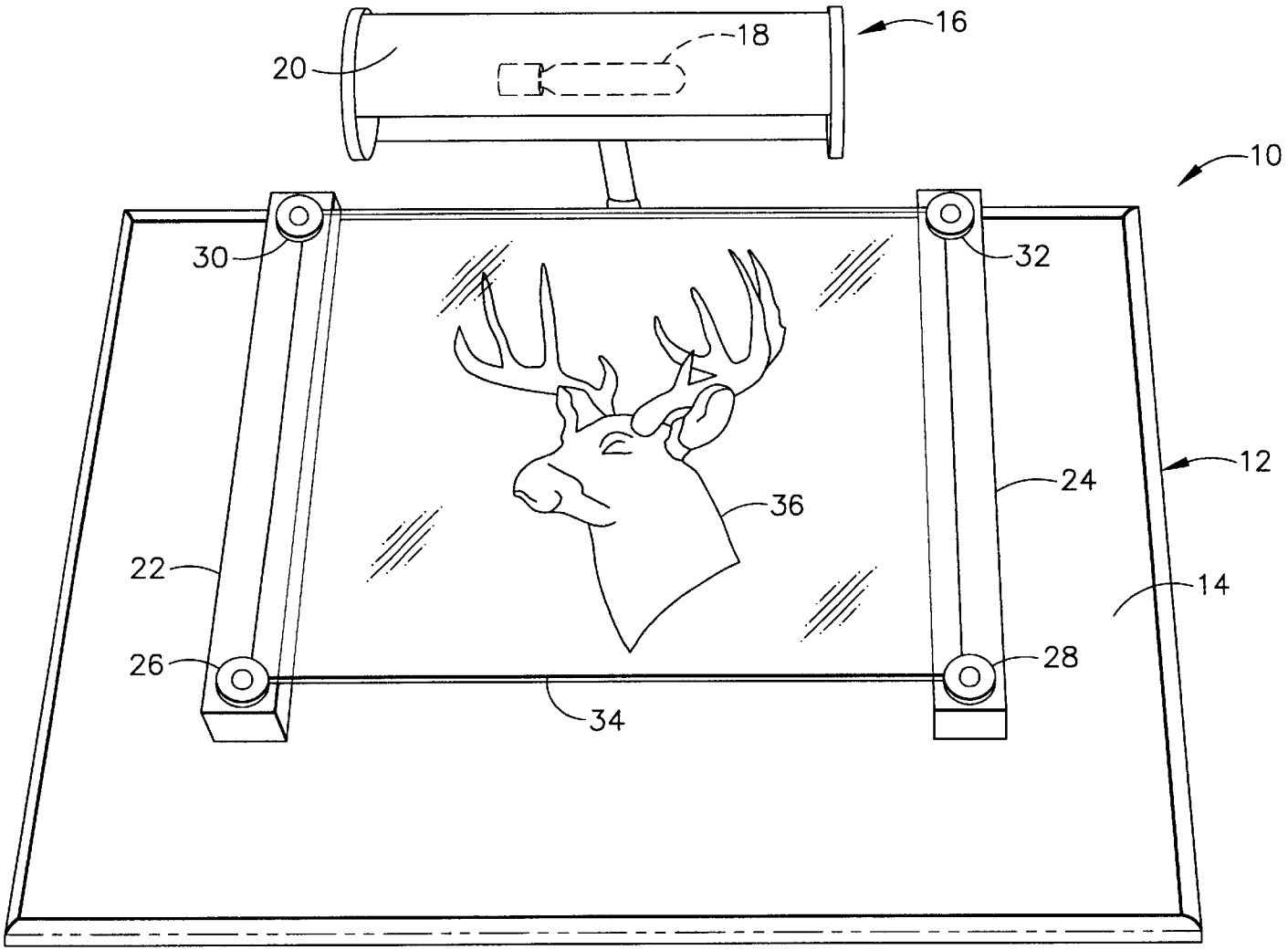
FIG. 1 is a perspective view of an illuminated support in accordance with an embodiment of the present invention.
Figure 2:
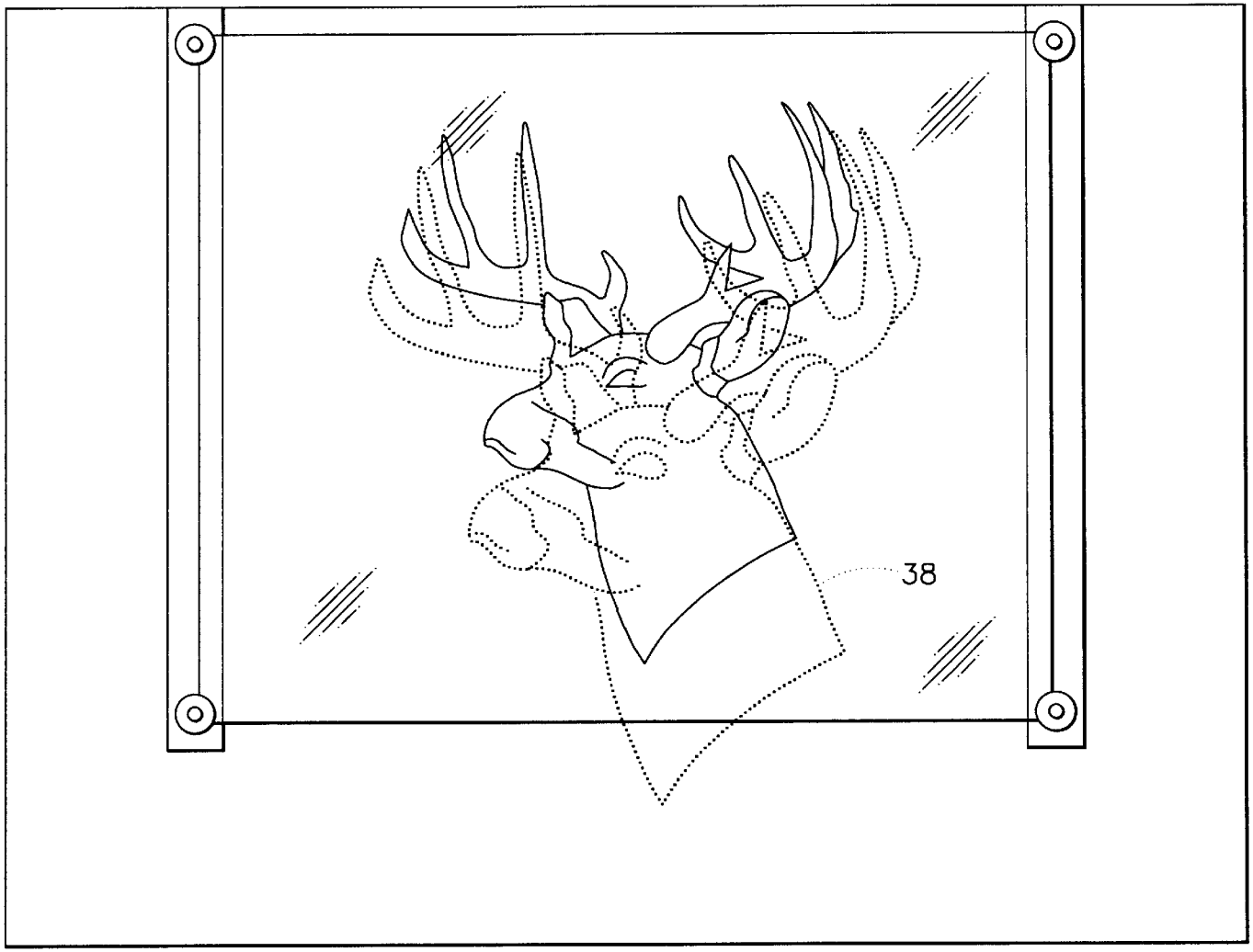
FIG. 2 is a plan view illustrating the shadow effect created by the present invention.

Referring to FIGS. 1 and 2, there is shown an illuminated mounting support for holding and displaying artwork on transparent media, designated generally as 10, in accordance with the preferred embodiment of the present invention. The support 10 comprises a generally rectangular shaped mounting surface 12 with at least one flat side 14. The shape of the mounting surface 12 is not critical. The mounting support 10 is preferably made of natural oak which may be white-washed to produce a light reflective surface. Attached to the top of support 10 is a lamp assembly 16. The lamp assembly 16 comprises a conventional light source 18 such as a flourescent or incandescent bulb powered by an electrical source such as a battery and a shade 20 which directs light rays toward the flat side 14 of the mounting surface 12.

It will be appreciated that the lamp assembly 16 may be attached to the support 10 at other locations along its border, such as along either side or at the bottom. The lamp assembly 16 extends a short distance perpendicular to the plane of the support 10. The mounting surface 12 further comprises two mounting strips 22, 24 affixed parallel to each other and in a spaced apart relationship of slightly greater distance than the width of the lamp assembly 16. Each strip has a fastener 26, 28, 30, and 32 proximate its end which can be adjusted to trap and hold a portion of the perimeter of a pane of glass 34 or other transparent media sheet such as acrylic, plexiglass or plastic. Etched, printed or otherwise incorporated on or in the glass is an image, such as a deer 36. Other images, for example architectural renderings, are within the spirit of the invention. It will be appreciated that the precise shape of the mounting strips is not critical so long as their thickness results in the glass etching being offset from the mounting surface 12 and so long as the glass etching is held between the mounting surface 12 and the lamp assembly 16.

When the light source 18 is turned on, the image on the glass is projected and enlarged on the mounting surface 12. The resultant effect 38 is one of a ghost-like or shadow effect which creates a perception of depth for the viewer. The effect is enhanced by its similarity to an enlarged carbon sketch of the image. The appearance may be further enhanced by the beauty of the grain of the wood from which the mounting surface 12 is and by surface treatments for the wood which are well known hose skilled in the art of wood staining and polishing.

One of the desirable features of the present invention is that the visual effect may be appreciated even where access to natural or other sources of artificial light is unavailable or restricted and the level of the ambient light is reduced.

The distance of offset of the glass 34 and the lamp assembly from the mounting surface 12 may be selected to enlarge the projected image and to affect its focus, depending upon what is most pleasing to the viewer.

Hence, it is believed that the invention permits the creation of a new and unique display of artwork suitable for display in a number of different settings. The visual effect is not only pleasing to the eye, but also produces a sensation of depth.

I claim:

1. An illuminated mounting support comprising:

a. A mounting surface with at least one flat side, said flat side being light reflective;

b. Means attached to said mounting surface for holding a transparent sheet offset from said mounting surface;

c. A transparent sheet with an image thereon affixed to said mounting surface by said holding means; and d. A light source positioned to direct rays of light through the transparent sheet and against said mounting surface, whereby said image is projected and enlarged on said mounting surface creating a ghost-like effect of said image.

2. An illuminated mounting support according to claim 1 wherein said mounting surface is made of wood.

3. An illuminated mounting support according to claim 1 wherein said transparent sheet is glass.

4. An illuminated mounting support according to claim 1 wherein said image is etched on said transparent sheet.

5. An illuminated mounting support according to claim 1 wherein said light source is shaded to direct said rays of light only in the direction of said mounting surface.

6. An illuminated mounting support according to claim 1 wherein said holding means are adjustable to trap and hold at least a portion of the perimeter of said transparent sheet.

7. An illuminated mounting support according to claim 1 wherein said light source is incandescent.

8. An illuminated mounting support according to claim 1 wherein said light source is attached to said mounting support.

* * * * *